US010947030B2

(12) United States Patent
Baker et al.

(10) Patent No.: US 10,947,030 B2
(45) Date of Patent: Mar. 16, 2021

(54) MOUNTING CUP FOR PRESSURIZED CONTAINER

(71) Applicant: Clayton Corporation, Fenton, MO (US)

(72) Inventors: Mark Baker, St. Louis, MO (US); Kevin Robert Martz, Desoto, MO (US); Richard Berger, Troy, MO (US)

(73) Assignee: Clayton Corporation, Fenton, MO (US)

( * ) Notice: Subject to any disclaimer, the term of this patent is extended or adjusted under 35 U.S.C. 154(b) by 0 days.

(21) Appl. No.: 16/551,331

(22) Filed: Aug. 26, 2019

(65) Prior Publication Data

US 2020/0062490 A1 Feb. 27, 2020

Related U.S. Application Data

(60) Provisional application No. 62/722,685, filed on Aug. 24, 2018.

(51) Int. Cl.
*B65D 83/48* (2006.01)
*B65D 83/40* (2006.01)

(52) U.S. Cl.
CPC ..... *B65D 83/48* (2013.01); *B65D 83/40* (2013.01)

(58) Field of Classification Search
CPC ..... B65D 83/48; B65D 83/40; B65D 83/38; B65D 83/64; B65D 83/70; B65D 83/24
See application file for complete search history.

(56) References Cited

U.S. PATENT DOCUMENTS

| | | | | |
|---|---|---|---|---|
| 3,393,842 | A | 7/1968 | Bruce et al. | |
| 4,073,398 | A | 2/1978 | Schultz | |
| 4,171,074 | A | 10/1979 | Diamond | |
| 4,773,553 | A | 9/1988 | Van Brocklin | |
| 4,995,417 | A | 2/1991 | Naku | |
| 5,450,989 | A * | 9/1995 | Gilroy | B65D 83/38 222/402.1 |
| 5,785,301 | A | 7/1998 | Scheindel | |
| 6,189,741 | B1 | 2/2001 | Behar | |
| 6,244,475 | B1 | 6/2001 | Walz et al. | |
| 6,382,990 | B1 | 4/2002 | Marechal et al. | |
| 7,234,460 | B2 | 6/2007 | Greenleaf et al. | |
| 7,757,902 | B2 | 7/2010 | Bevans et al. | |
| 8,602,271 | B2 | 12/2013 | Winker et al. | |
| 8,746,512 | B2 | 6/2014 | Miyamoto et al. | |
| 8,757,409 | B2 | 6/2014 | Behar | |

(Continued)

FOREIGN PATENT DOCUMENTS

| | | |
|---|---|---|
| EP | 2865611 A1 | 4/2015 |
| FR | 2534557 A3 | 4/1984 |

*Primary Examiner* — David P Angwin
*Assistant Examiner* — Bob Zadeh
(74) *Attorney, Agent, or Firm* — Stinson LLP

(57) ABSTRACT

The present disclosure relates to a valve for dispensing flowable product from a container under pressure, the valve comprising a stem, a seal coupled to the stem, and a mounting cup configured to mount the valve to the container, wherein each of the stem, seal, and mounting cup comprises a recyclable plastic, and wherein the valve is free from a gasket configured to surround an opening of the container to form a seal between the valve and the container. Also provided herein is a container for dispensing a flowable product under pressure comprising the valve as described above.

19 Claims, 15 Drawing Sheets

(56) References Cited

U.S. PATENT DOCUMENTS

| | | | | |
|---|---|---|---|---|
| 8,844,770 | B2 | 9/2014 | Jourdin et al. | |
| 9,394,098 | B2 | 7/2016 | Kohls et al. | |
| 9,573,750 | B2 | 2/2017 | Seling et al. | |
| 9,919,862 | B2 | 3/2018 | Smith et al. | |
| 2007/0017582 | A1 | 1/2007 | Chenvainu et al. | |
| 2009/0001103 | A1 | 1/2009 | Wanbaugh | |
| 2009/0014679 | A1 | 1/2009 | Hygema et al. | |
| 2011/0101036 | A1 | 5/2011 | Wanbaugh et al. | |
| 2011/0108579 | A1 | 5/2011 | Martorell Pena et al. | |
| 2011/0215119 | A1 | 9/2011 | McBroom | |
| 2012/0199612 | A1 | 8/2012 | Demarest et al. | |
| 2013/0118641 | A1 | 5/2013 | Beranger | |
| 2013/0153674 | A1* | 6/2013 | Stern | B65D 83/54 239/1 |
| 2015/0108163 | A1 | 4/2015 | Smith et al. | |
| 2015/0108387 | A1* | 4/2015 | Smith | F16K 1/34 251/333 |
| 2015/0183571 | A1* | 7/2015 | Anderson | B65D 83/48 222/153.12 |
| 2018/0134481 | A1* | 5/2018 | Bodet | B65D 83/207 |
| 2018/0201417 | A1 | 7/2018 | Douvdevani et al. | |
| 2020/0062490 | A1* | 2/2020 | Baker | B65D 83/48 |

* cited by examiner

MOUNTING CUP FOR PRESSURIZED CONTAINER

FIELD OF DISCLOSURE

The present disclosure generally relates to a valve for selectively dispensing flowable product from a pressurized container, and more specifically to a mounting cup that connects the valve to the pressurized container.

BACKGROUND

Pressurized containers may be used to dispense various flowable products, such as cleaning products, food condiments, shaving cream, pesticides, paint, and the like. Conventional pressurized containers, such as aerosol containers, use pressurized propellant to dispense the flowable product. The containers include a can that contains the flowable product and the propellant and a valve mounted to the can that is configured to be selectively actuatable (e.g. opened and closed) to allow the propellant to dispense the product out of the can. In general, valves for the pressurized containers are well known and include, for example, vertically actuated valves and tilt valves, among others. These valves generally include a mounting cup, a stem and a seal (e.g. a grommet) disposed between and interconnecting the stem and the mounting cup. The mounting cup is attached in and/or over an opening on the top of the can to mount the valve to the container.

BRIEF DESCRIPTION OF THE DRAWINGS

Corresponding reference characters indicate corresponding parts throughout the drawings.

DETAILED DESCRIPTION

Figure 1:
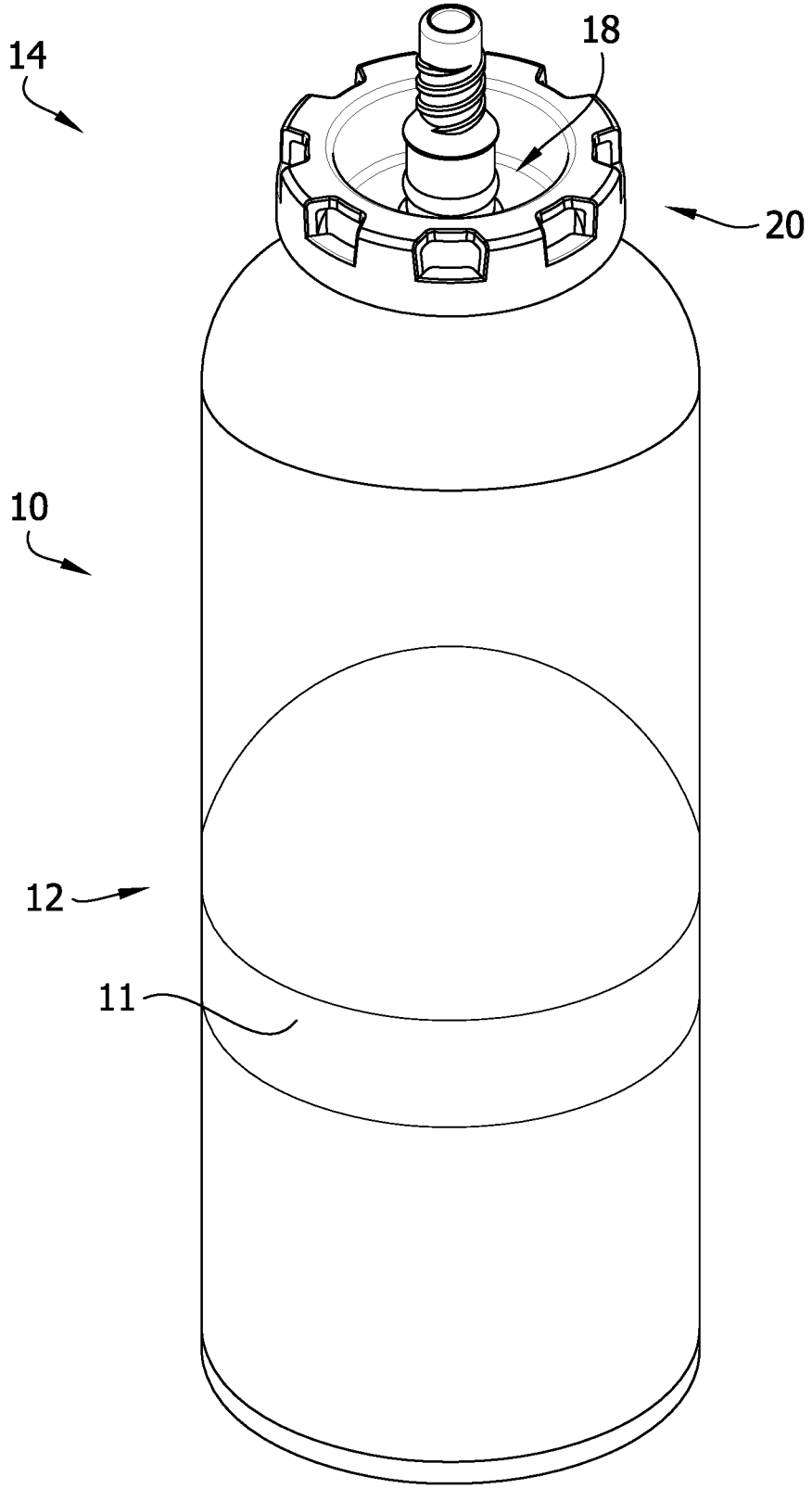
FIG. 1 is a perspective of a pressurized container including a valve with a mounting cup constructed according to the teachings of the present disclosure.
Figure 2:
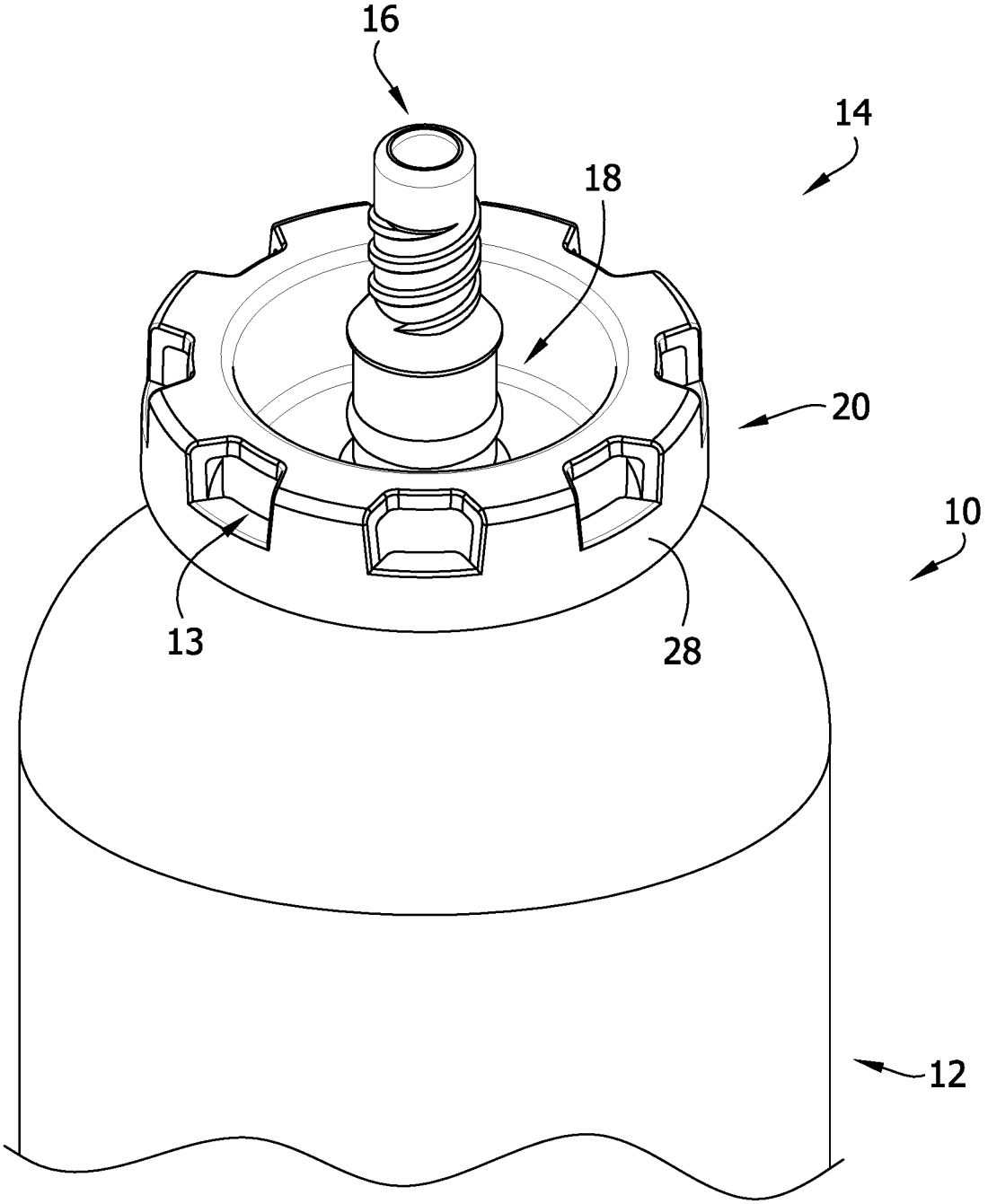
FIG. 2 is an enlarged perspective of the valve attached to the container.

Referring to the drawings, and in particular to FIGS. 1 and 2, a pressurized container is generally indicated at 10. The pressurized container 10 is configured to store and dispense a flowable product using pressurized propellant (e.g., an aerosol container). For example, the flowable product may be a flowable cleaner, which may include bleach or other corrosive chemical. The flowable product may include food product, or other types of flowable product. Also, as an example, the container may be pressurized by a propellant gas, including but not limited to nitrogen. It will be understood that various propellants and flowable products may be used in accordance with the teachings of the present disclosure.

The illustrated container 10 includes a container body (e.g., a can), generally indicated at 12, and a valve, generally indicated at 14, configured to be selectively operable to dispense the flowable product from the container 10. The valve 14 comprises a mounting cup, generally indicated at 20, a stem, generally indicated at 16, and a seal (e.g. a grommet), generally indicated at 18, attached to the stem and disposed between and interconnecting the stem and the mounting cup. As shown in FIGS. 1 and 2, the illustrated valve 14 is suitable for attachment to the container body 12, or other container, for dispensing flowable product contained within the container. When the valve 14 is actuated (e.g., opened), the valve fluidly couples an interior volume of the container body 12, allowing the flowable product to flow through the valve and out of the container 10. As used throughout the present disclosure with respect to the container 10, the terms defining relative locations and positions of structures and components of the container, including but not limited to the terms "inner," "outer," "upper," "lower," "top," and "bottom," are meant to provide a point of reference for such components and structures as shown in the drawings, with the understand that the respective relative locations of such components and structures will depend on the orientation of the container in use.

Referring to FIGS. 1 and 2, the container body 12 has a base and top spaced apart along a height. The base forms the closed bottom of the container body 12, and the top includes a neck 15 (FIG. 6) that defines an opening to an interior of the container body. The neck 15 is generally cylindrical in shape with an interior surface defining the opening. The neck 15 includes a flange or lip 13 at the upper end thereof (e.g. at the upper end of the container body 12 adjacent the opening) that extends circumferentially around and defines the upper portion of the opening. Referring to FIGS. 1 and 2, the mounting cup 20 of the valve 14 is shown attached to the container body 12 at the opening of the container body. As explained in more detail below, when the mounting cup 20 of the valve 14 is attached to the container body 12, the mounting cup 20 engages the lip 13 to secure the mounting cup on the container body and a portion of the mounting cup extends into the opening along the neck 15. When the valve 14 is secured to the neck 15 and closed, as shown, the valve closes the opening. Accordingly, the container body 12 and the valve 14 enclose the flowable product and propellant in the interior of the container body. In various embodiments, the container body 12 can also include a collapsible bag (not shown) that contains the flowable product and the propellant can be located in the interior of the container body but outside of the collapsible bag to prevent intermixing of the flowable product and propellant. In the illustrated embodiment, the container 10 includes a piston 11 slidably received in the container body 12 and divides the interior into an upper portion and a lower portion, relative to the base of the can. In this embodiment, the flowable product is received in the upper portion of the interior and the propellant is received in the lower portion. When the valve 14 opens, the propellant drives the piston 11 upward toward the valve to dispense the flowable product through the valve. Other configurations for dispensing flowable product from the container 10 are within the scope of the present disclosure. For example, as known in the art, the container 10 may not include the piston 11 and instead the propellant and flowable product may mix in the interior. The container body 12 can be formed from plastic, metal or any other suitable material.

Figure 3:
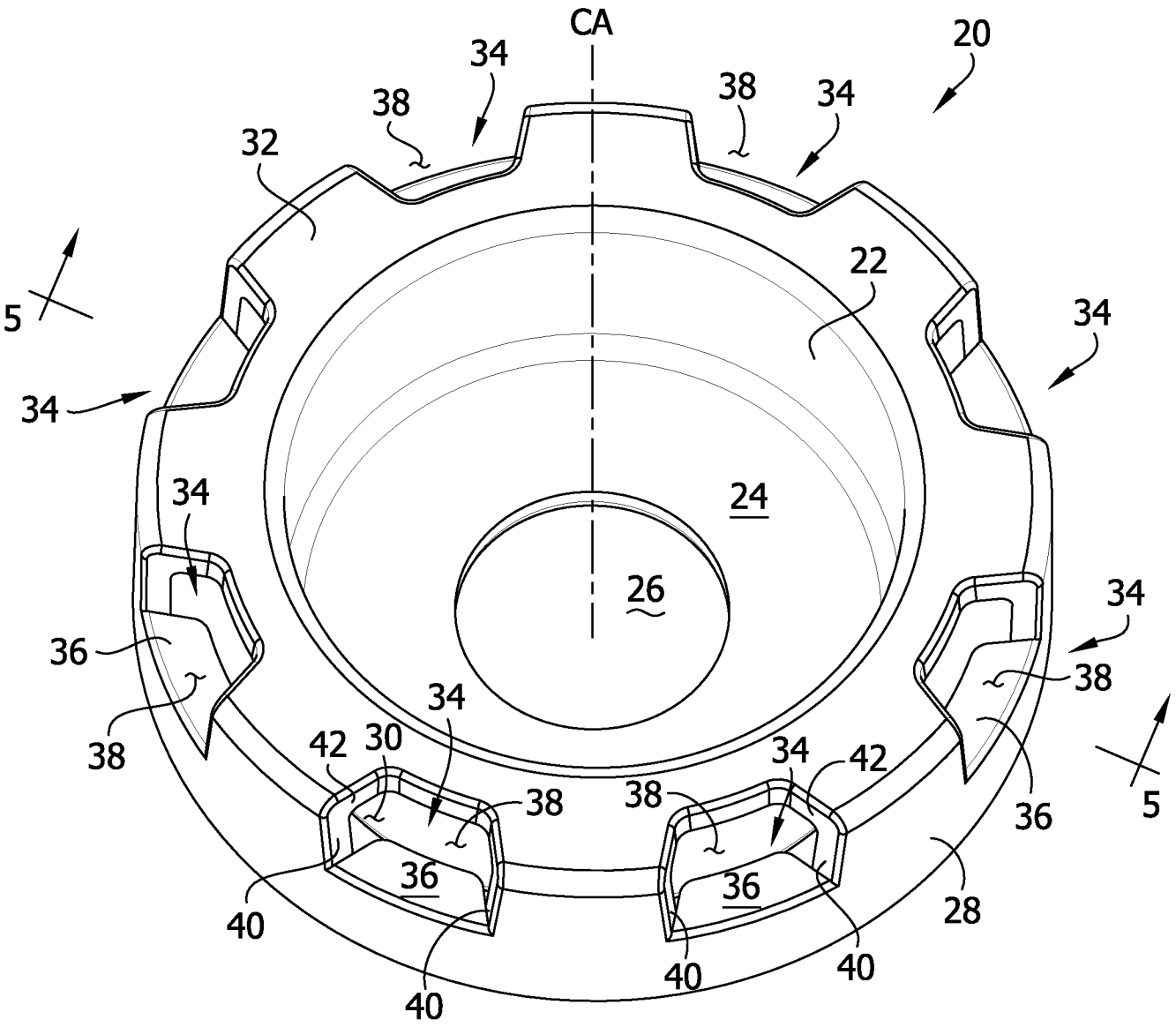
FIG. 3 is a top perspective of the mounting cup.
Figure 4:
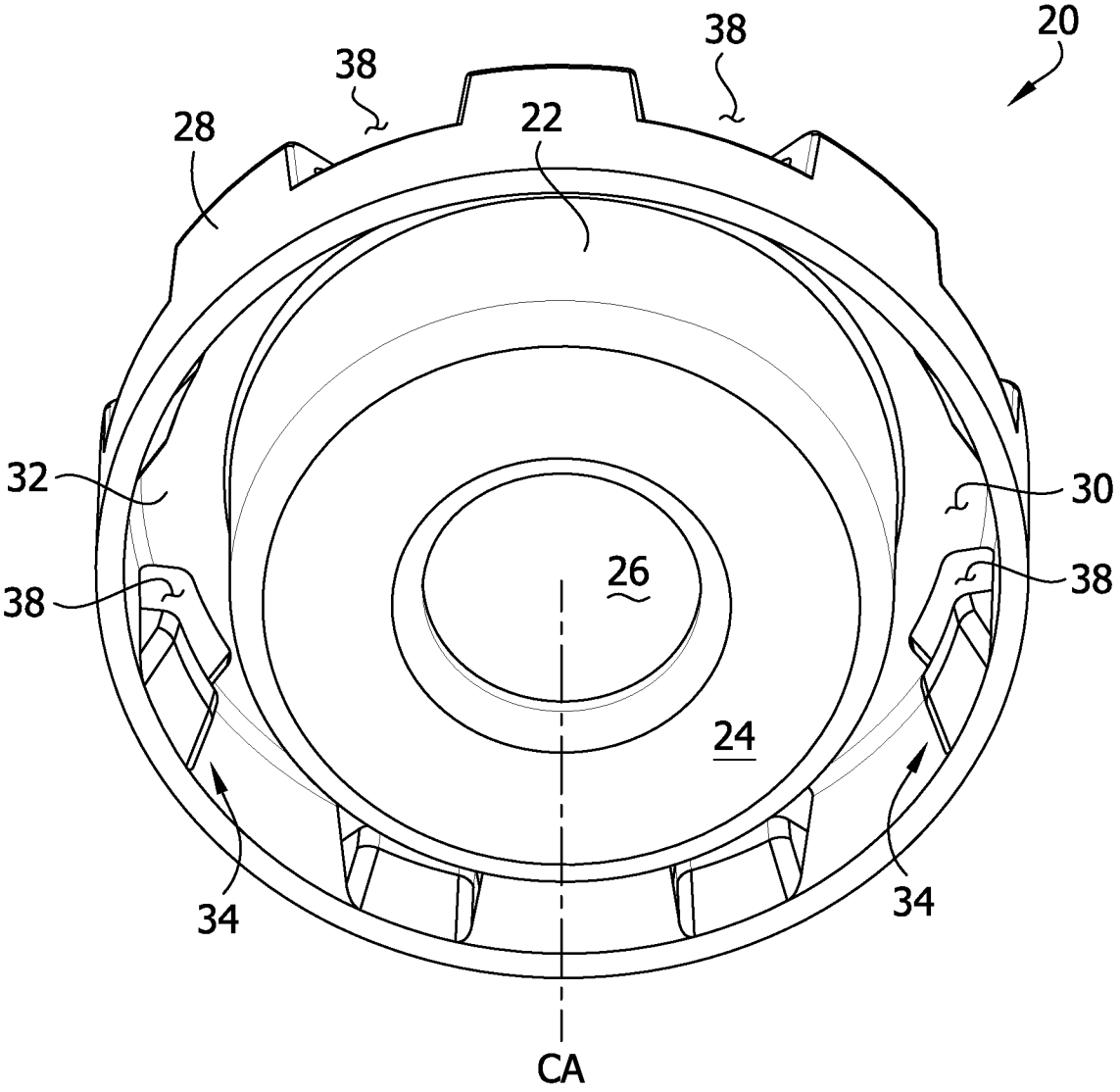
FIG. 4 is a bottom perspective of the mounting cup.
Figure 5:
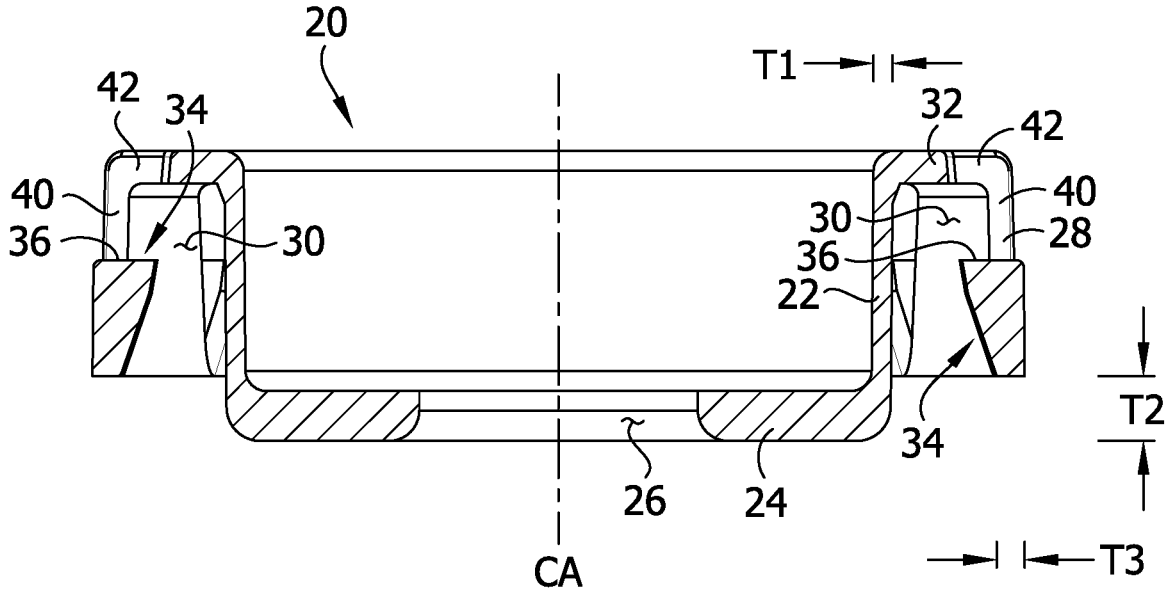
FIG. 5 is a section of the mounting cup taken through line 5-5 in FIG. 3.
Figure 8:
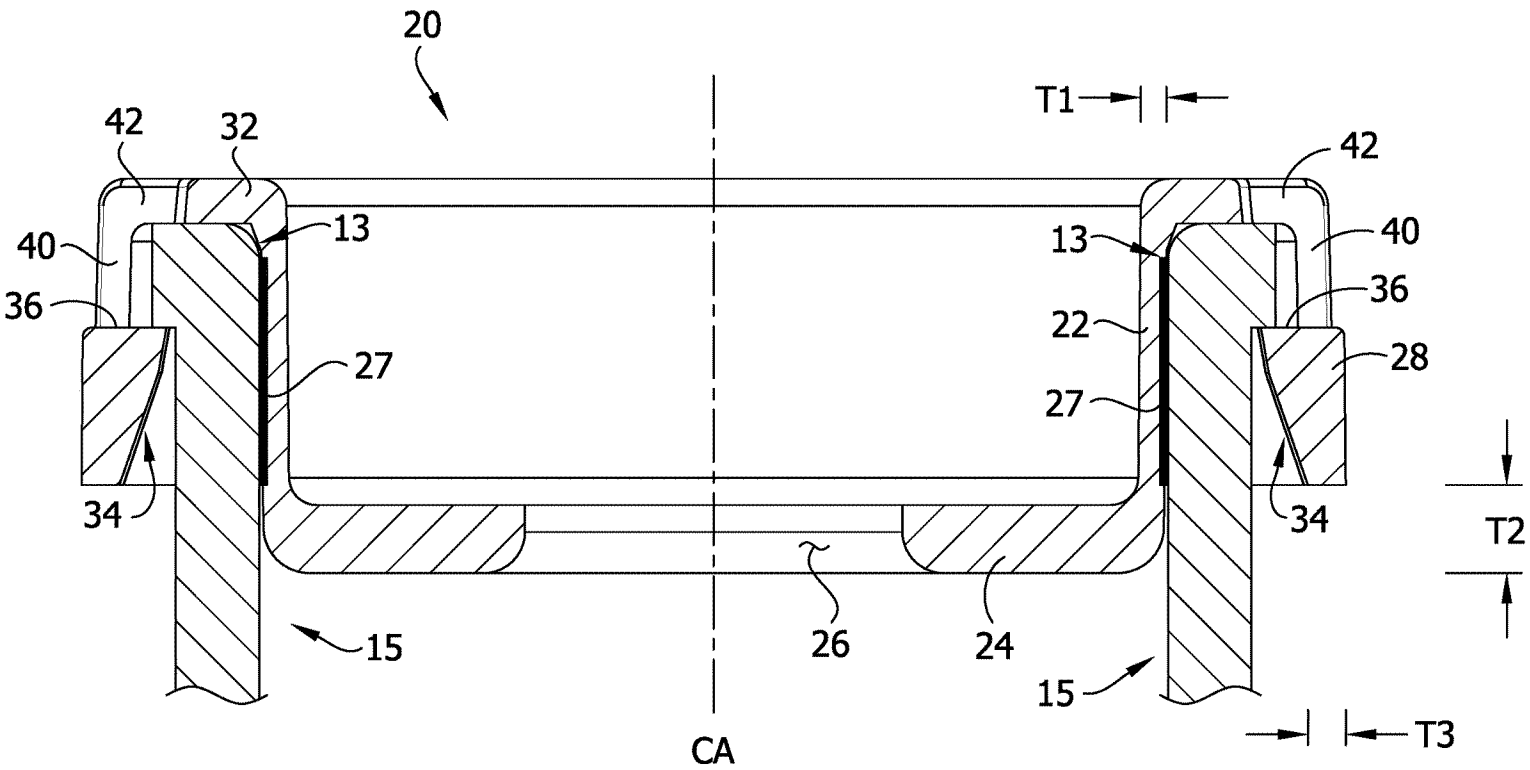
FIG. 8 is another embodiment similar to FIG. 6, including a laminated film or co-molded material between the container and the valve.

Referring to FIGS. 3-5, the mounting cup 20 of the valve 14 includes a generally annular inner wall 22 defining a central axis CA of the mounting cup. Substantially an entirety of the annular inner wall 22 is generally parallel to the central axis CA of the mounting cup 20. When the mounting cup 20 is attached to the container body 12 (FIGS. 1 and 2), the annular inner wall 22 extends into the opening on the top of the container body and engages the portion of the container that defines the opening. As described in more detail below, the annular inner wall 22 is configured to deform or deflect outward (e.g., bow outward) under pressure (e.g., when the interior of the container is pressurized) and engage the portion of the container body 12 defining the opening (e.g. the neck 15) to form a leak proof seal between the mounting cup 20 and the container body. The inner wall 22 has a thickness T1 (FIG. 5) extending between interior and exterior surfaces of the inner wall. The mounting cup 20 includes a base 24 extending radially inward (e.g. toward the central axis CA) from adjacent a lower end of the inner wall 22. The base 24 defines a circular mounting opening 26, also known as a pierce hole, sized and shaped to receive the seal 18 of the valve 14. As shown in FIGS. 1 and 2 the seal 18 and stem 16 extend through the mounting opening 26. The mounting opening 26 is aligned with the central axis CA of the mounting cup 20 such that the central axis extends through the center of the opening. As discussed below, the base 24 forms a seat for sealing engagement with a portion of the grommet 18. The base 24 may be substantially planar. The base 24 has a thickness T2 (FIG. 5) extending between upper and lower surfaces of the base. In the preferred embodiment the thickness T1 of the inner wall 22 is less than the thickness T2 of the base 24 (e.g. the thickness of the base is greater than the thickness of the inner wall). In the illustrated embodiment, the thickness T1 of the inner wall 22 is 0.031 inches (0.78 mm) and the thickness T2 of the base 24 is 0.074 inches (1.88 mm). The internal pressure in the container body 12 pushes against the base 24, thereby causing the annular inner wall to bow outward (broadly, deflect or deform) and sealingly engage the interior surface defining the opening of the container body. In other embodiments, such as shown in FIG. 8, a laminated film or co-molded (e.g., co-injection molded) material 27 may be included on the exterior surface of the inner wall 22. In this embodiment, the laminated film or co-molded material 27 (broadly, a sealing material) is compressed between the inner wall 22 and the container body 12 to enhance the leak proof seal between the mounting cup 20 and the container body.

Figure 6:
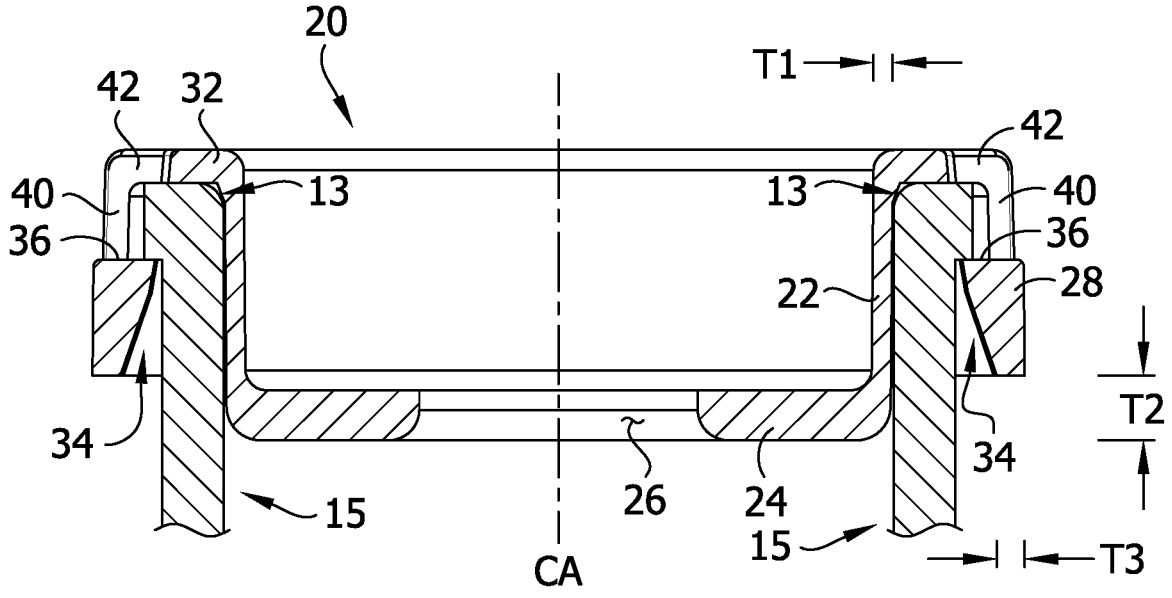
FIG. 6 is a section of the mounting cup of FIG. 5 attached to the container.
Figure 9:
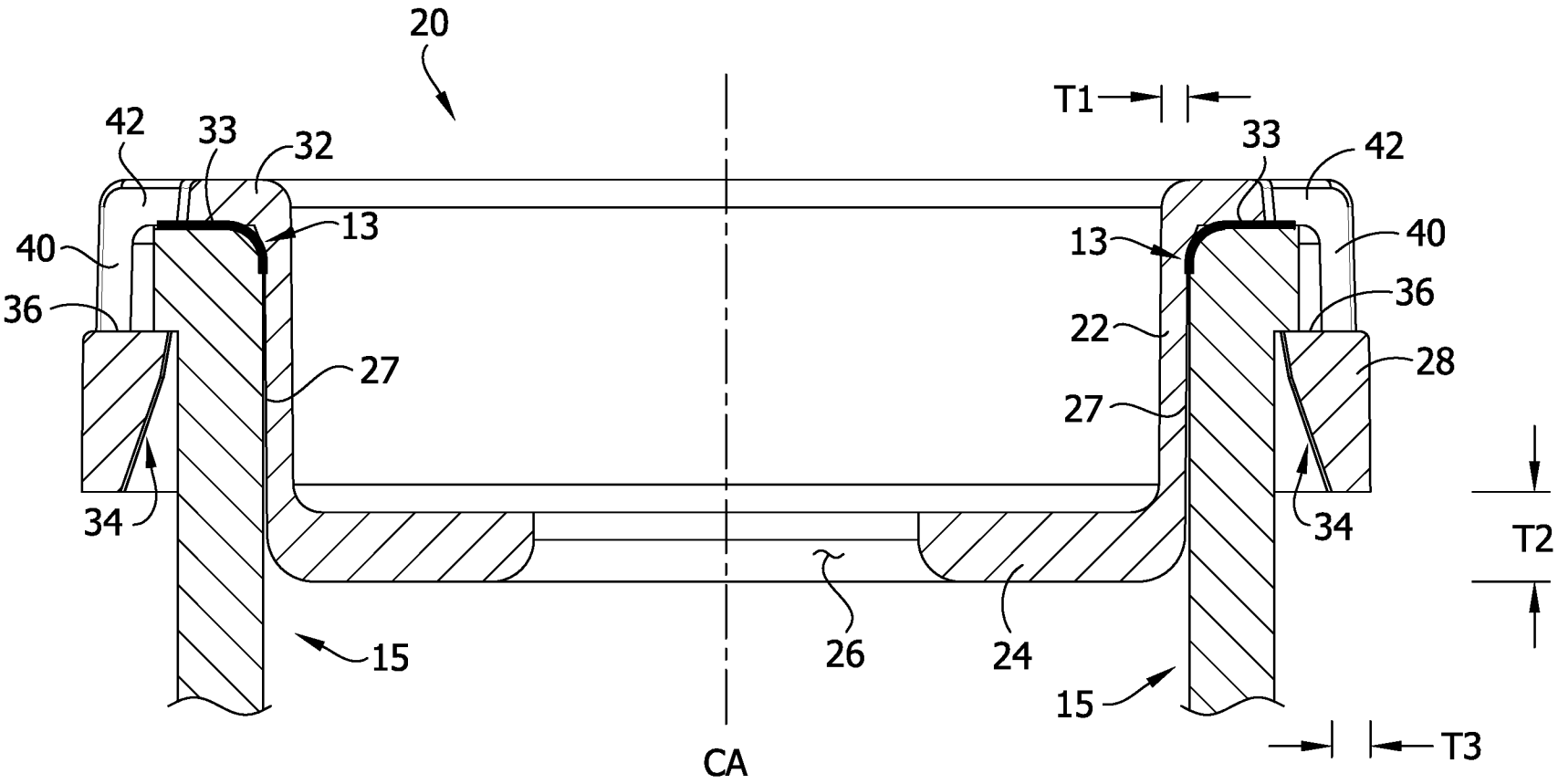
FIG. 9 is another embodiment similar to FIG. 6, including a gasket disposed in a lip-receiving space.

The mounting cup 20 further includes an annular outer wall 28 disposed radially outward of the annular inner wall relative to the central axis CA. The annular inner and outer walls 22, 28 are generally parallel to the central axis CA of the mounting cup 20, and generally oppose one another. The annular outer wall 28 is radially spaced apart from the annular inner wall 22. The inner and outer walls 22, 28 at least partially define a lip-receiving space 30 therebetween (FIGS. 4 and 5). As explained in more detail below, the lip-receiving space 30 is configured to receive the lip 13 of the container body 12. A lower end of the outer wall 30 forms a continuous (e.g., uninterrupted, unbroken, solid) retaining ring. The outer wall 28 has a thickness T3 (FIG. 5) extending between interior and exterior surfaces of the outer wall. In the preferred embodiment, the thickness T3 of the outer wall 28 is slightly greater than the thickness T1 of the inner wall 22. In the illustrated embodiment, the thickness T3 of the outer wall 28 is 0.042 inches (1.07 mm). A top flange 32 (e.g., a ring) extends radially outward from adjacent an upper end of the inner wall 22 to adjacent an upper end of the outer wall 28. The top flange 32 interconnects the inner and outer walls 22, 28. The top flange 32 defines the upper end of the lip-receiving space 30. Accordingly, the lip-receiving space 30 is a generally circular channel with the inner and outer walls 22, 28 defining sides of the channel and the top flange 32 defining a closed top of the channel. In the illustrated embodiment, the top flange 32 is generally planar and extends perpendicularly to the central axis CA and the inner and outer walls 22, 28. An interior surface of the top flange 32 is configured to directly engage the lip 13 of the container body 12 when the lip is received in the lip-receiving space 30 (FIG. 6). In the illustrated embodiment, the mounting cup 20 is free from a gasket or other seal (broadly, sealing material) between the top flange 32 and the lip 13. It is believed that the gasket may be unnecessary because of the seal formed between the annular inner wall 22 and the interior surface of the container body 12 defining the opening. In other embodiments, such as shown in FIG. 9, a gasket 33, such as a lathe cut gasket, O-ring or co-injection molded material, may be disposed in the lip-receiving space 30, such as between the top flange 32 and the lip 13, to further facilitate the formation of the leak-proof seal between the mounting cup 20 and the container body 12.

Referring to FIGS. 4 and 5, the mounting cup 20 includes a plurality of detents 34 (e.g., a catch) on the annular outer wall 28 extending radially inward toward the annular inner wall 22. The detents 34 are configured to engage the lip 13 (e.g., the underside of the lip) of the container body 12 when the lip is received in the lip-receiving space 30 to secure (e.g., by snap-fit connection) the mounting cup 20 to the container body (FIG. 6). The detents 34 extend radially inward from the annular outer wall 28 toward the central axis CA of the mounting cup 20. The detents 34 are positioned between the upper and lower ends of the annular outer wall 28. Each detent 34 includes a shoulder 36 at the upper end thereof. The shoulder 36 is configured to engage the underside of the lip 13 of the container body 12, such that the lip is captured between the shoulder and the top flange 32. The shoulder 36 generally corresponds to the shape of the underside of the lip 13. In the illustrated embodiment, the shoulder 36 is generally flat because the underside of the lip 13 is generally flat. The shoulder 36 is generally perpendicular to the central axis CA and the inner and outer walls 22, 28. Moreover, the geometry of the mounting cup 20 allows for molding of the detents 34 in such a manner that the shoulder 36 of the detent can be formed in a range of about 30° to 90° relative to the central axis CA of the mounting cup while maintaining the fully circumferential outer wall 28. Other configurations of the shoulder 36 are within the scope of the present disclosure. Each detent 34 tapers in a direction that is radially outward and toward the outer wall 28 as the detent extends downward along the outer wall from the shoulder 36. In the illustrated embodiment, the taper of the detent 34 ends at the lower end of the outer wall 28. As shown in FIG. 5, the taper of the detent 34 is a generally straight (e.g., linear) taper as shown in cross section with two sections tapered at different angles. It is understood that in other embodiments the taper may be curvilinear or other shapes in cross section. The detents 34 are integrally formed with the outer wall 28. The detents 34 may have other configurations, such as flaps, or barbs, or tabs, or nubs, or springs, or other structures capable of gripping the container body 12. For example, it is understood that the plurality of detents 34 can be replaced with a single, continuous detent (not shown) that extends circumferentially to engage the lip 13 of the container body 12.

In the illustrated embodiment, the detents 34 are evenly spaced apart, circumferentially, on the outer wall 28. In the illustrated embodiment, the plurality of detents 34 includes eight individual detents. It is understood the mounting cup 20 may include more or less detents 34, however, in the preferred embodiment, the mounting cup 20 includes at least eight individual detents. As mentioned above, the lower end of the outer wall 28 forms a continuous (e.g. uninterrupted, unbroken, solid) retaining ring. In the illustrated embodiment, the detents 34 are formed on the retaining ring and extend radially inward therefrom.

Referring to FIG. 3, the top flange 32 and the outer wall 28 define a plurality of openings 38 therein. Each opening 38 corresponds to and is positioned above a corresponding one of the individual detents 34. Accordingly, in the illustrated embodiment, the number of openings 38 corresponds to the number of detents 34. It is understood that in other embodiments, one or more of the detents 34 (including all of the detents) may not have a corresponding opening 38. The portion of each opening 38 defined by the outer wall 38 is defined by opposite intermediate sides 40 of the outer wall. The intermediate sides 40 extend upward from either side of the detent 34 (e.g. the detent defines a lower end of the opening 38). As the intermediate sides 40 extend upward, the sides slightly diverge away from each other. Accordingly, a distance along the outer wall 28 between adjacent openings 38 is slightly shorter at the upper end of the outer wall than the distance at the detents 34. The portion of each opening 38 defined by the top flange 32 is also defined by opposite intermediate sides 42 of the top flange. The intermediate sides 42 extend generally inward (e.g. toward the inner wall 22) from the outer wall 28. As the intermediate sides 42 extend inward, the sides slightly converge toward one another. Accordingly, a distance along the top flange 32 between adjacent openings 38 is slightly less than adjacent the outer wall 28 than the distance radially inward of the outer wall. The intermediate sides 42 extend about halfway between the inner and outer walls 22, 28 (e.g. about halfway across the top flange 32). This configuration of the openings 38 weakens the top flange 32 and outer wall 28 at their intersection to facilitate the deflection of the outer wall, as explained in more detail below. Other configurations of the openings 38 are within the scope of the present disclosure. For example, the top flange 32 may not define any portion of the openings 38 such that the openings are entirely defined by the outer wall 28.

The mounting cup 20 is configured for reception into the opening of the container body 12, such as the opening at the top of the container body (as shown in FIGS. 1 and 2). When the mounting cup 20 is attached to the container body 12, the lip 13 of the container body mates with the mounting cup. The mounting cup 20 is secured to the container body 12 by a snap-fit connection. The detents 34 are deflectable (e.g. resiliently deflectable or deformable) in a radially outward direction relative to the central axis CA. To attach the mounting cup 20 to the container body 12, the mounting cup is aligned with the opening in the container body such that the lip-receiving space 30 is positioned above the lip 13. The mounting cup 20 is then moved downward into the opening in the container body such that the lip 13 moves into the lip-receiving space 30. As the lip 13 moves into the lip-receiving space 30, the tapered portions of the detents 34 contact the lip 13, deflecting the detents 34 radially outward. Once the detents 34 move past the lip 13, the detents snap back into place (e.g., the outer wall moves radially inward) to its original position such that the each detent engages the underside of the lip. Referring to FIG. 6, the detents 34 are configured to apply a gripping force on the container body 12 to secure the mounting cup 20 thereon. The shoulder 36 of each detent 34 engages and applies the gripping force to the underside of the lip 13 of the container body 12 to hold the mounting cup 20 on the container body. When the mounting cup 20 is attached to the container body 12, the inner wall 22 extends into the opening of the container body and is in a snug or friction fit with the neck 15 (e.g., the exterior surface of the inner wall engages or contacts the interior surface of the neck). In other embodiments the inner wall 22 may only be adjacent to the neck 15 and not engage the neck until the container 10 is pressurized, as described below. In addition, the top flange 32 is in direct engagement with the lip 13 (FIG. 6). In this embodiment, the mounting cup 20 directly engages the container body 12. More specifically, the container 10 is free of any sealing element (e.g., gasket) positioned between the mounting cup 20 and the container body 12 that would create a fluid tight or leak proof seal between the two components. In various embodiments, the seal is created through engagement between the inner wall 22 and the neck 15, as described below. In other embodiments, the leak proof seal may be formed or enhanced by the use of a gasket between the mounting cup 20 and the container body 12. Additionally, the connection between the mounting cup 20 and the container body 12 can be reinforced through the use of any suitable plastic bonding technique, such as but not limited to ultrasonic welding, spin welding, solvent bonding, or the use of adhesives. In other embodiments, the use of any suitable plastic bonding technique, such as but not limited to ultrasonic welding, spin welding, solvent bonding, or the use of adhesives replaces the seal otherwise formed by snap-fit connection of the detents.

Because the mounting cup 20 is attached to the container body 12 with a snap-fit connection, the mounting cup of the present disclosure reduces the number of steps required to construct the container 10. For example, traditional mounting cups made of metal require the metal mounting cup to be placed on the container body and then crimped (e.g. clinched) or otherwise fastened to the container body. Similarly, previous snap-fit mounting cups made of plastic typically included a support or reinforcement ring that would surround and reinforce the snap-fit connection to provide the necessary strength to keep the plastic snap-fit mounting cup on the container body once the container is pressurized. This reinforcement ring would be moved into position after the snap-fit mounting cup is positioned on the container body. However, the mounting cup 20 of the present disclosure requires no such crimping or positioning of a reinforcement ring step to attach the mounting cup to the container body 12. In other embodiments, the mounting cup 20 can be integrally formed with an actuator configured to actuate the valve. In this case, the number of steps required to construct the container 10 is further reduced because the actuator would not need to be attached to the valve after the valve is attached to the container body (or attached to the valve before the valve is attached to the container body). Moreover, the illustrated container 10, as constructed according to the teachings herein, does not require the step of placing a sealing element between the valve 14 and container body 12, as described in more detail below.

The mounting cup 20 may be formed from a single piece of material such as but not limited to plastic (e.g., polyolefin, PET or other suitable material). That is, the annular inner wall 22, the base, the annular outer wall 28, and the plurality of detents 34 are integrally formed as a single, one-piece component. For example, the mounting cup 20 may be free from metal. Moreover, the valve 14 may be free from any metal and may consist essentially of recyclable plastic. For example, the mounting cup, stem, and any other component except for the grommet may comprise, for example, polyethylene terephthalate (PET), polyethylene naphthalate (PEN), nylon, ethylene vinyl alcohol (EVOH), or any combination thereof. In various embodiments, the mounting cup, valve, and any other component except for the grommet may comprises, for example, PET, high-density polyethylene (HDPE), polyvinyl chloride (PVC), low-density polyethylene (LDPE), polypropylene (PP), or any other plastic, or any combination thereof. As an example, the mounting cup, valve, and all other components except for the grommet may be selected from a single class of recyclable materials, as set forth by the Society of Plastics Industry. In one embodiment, the valve or all components of the pressurized container, including the valve, may be recycled in a single class of recycling. For example, the pressurized container (except for the grommet) may comprise, consist essentially of, or consist of a single class of materials as defined by the Society of Plastics Industry. For example, the pressurized container (except for the grommet) may comprise, consist essentially of, or consist of class 1 materials (PET), class 2 materials (HDPE), class 3 materials (PVC), class 4 materials (LDPE), class 5 materials (PP), class 6 materials (PS), or class 7 materials (other, typically polycarbonate or acrylonitrile butadiene styrene (ABS)). In the one or more embodiments, the valve mounting cup 20 is made of (e.g., comprises, consists essentially of, or consists of) PET (i.e., Class 1 material), and the stem, seal and any other component are made of recyclable plastic material from a Class of recyclable plastic other than Class 1 recyclable plastic (i.e., other than PET). In one example where recyclable plastic materials other than Class 1 are used, the plastic material used have a density less than water (e.g., less than about 1 g/cm$^3$). By using recyclable plastic materials other than PET with a density less than water (e.g., less than about 1 g/cm$^3$), a container can be disposed of in a multi stream recycling bin for items, such as empty PET water bottles, and processed for recycling in the same material float/sink separation method.

Figure 7:
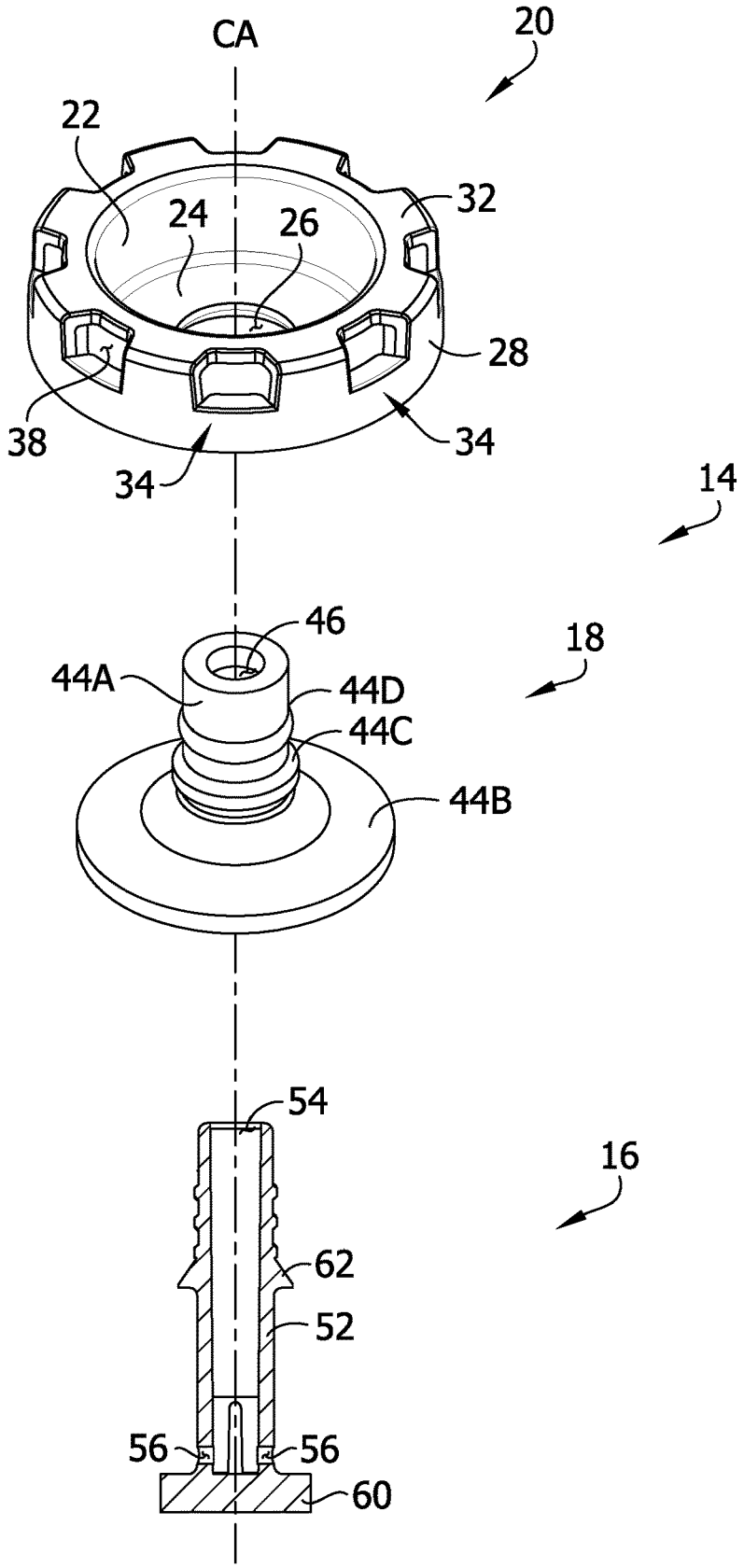
FIG. 7 is an exploded perspective of the valve.

Referring to FIGS. 1, 2 and 7, the illustrated valve 14 is a "tilt valve" or "toggle valve." Any suitable tilt valve may be used in other embodiments. In addition, other types of valves may be used in other embodiments, such as a "push down valve." The valve 14 is configured to be selectively operated from a non-actuated position to an actuated position to dispense the flowable product from the container body 12. The illustrated valve 14 includes the mounting cup 20, the stem 16, and the grommet 18. The illustrated valve 14 is free of a gasket that conventionally seals with a container body, and in particular, the lip or bead of a container body. The grommet 18 may be made of resilient material, such as a thermoplastic elastomer (TPE) or cross-linked rubber such as but not limited to neoprene or nitrile, so that it is resiliently deformable. For example, the TPE can comprise styrenic block copolymers (TPS), thermoplastic polyolefinelastomers (TPO), thermoplastic vulcanizates (TPV), thermoplastic polyurethanes (TPU), thermoplastic copolyester (TPC), thermoplastic polyamides (TPA), or any other type of TPE or combination thereof. The grommet 18 can be formed of recyclable plastic. The use of such grommets with a plastic mounting cup 20 and stem 16 allows for a container 10 that is a completely free of any metal which is beneficial in the packaging of chemicals which cannot contact metal (e.g., are chemically reactive with metal). Additionally the use of a thermoplastic elastomer allows for the valve 14 to be comprised entirely of plastic. Accordingly, the valve 14 may be multi-stream recyclable. When the container body 12 and valve 14 are made of all plastic materials, the entire container 10 may be multi-stream recyclable. The grommet 18 has an elongate neck portion 44A that extends through the mounting opening 26 of the mounting cup 20, and a flange portion 44B (i.e., seat) that extends radially outward at the bottom end of the neck portion of the grommet. A seal bead 44C of the grommet 18 extends radially outward from the neck portion 44A and overlies and presses against the upper surface of the base 24 of the mounting cup 20. An actuator seal 44D extends radially outward from the neck portion 44A and is configured to press against a component coupled to the neck portion (such as an actuator) to form a leak proof seal between the components. The flange portion 44B of the grommet 18 is thereby pressed against the base 24 of the mounting cup 20 to form a leak proof seal. An axially extending bore 46 extends from a top end through a bottom end of the grommet 18 to receive the valve stem 16 therein.

The valve stem 16 includes an elongate tubular stem body 52 and a disc 60 (or button) at the lower end of the stem. The stem 16 includes an outlet 54 and inlet(s) 56 at the upper and lower ends thereof, respectively. The stem body 52 extends through the bore 46, and the disc 60 seats against the flange portion 44B (i.e., seat) of the grommet 18 to form a leak proof seal when the valve 14 is in a non-actuated position. An upper portion of the stem body 52 is exposed and includes an annular shoulder 62 extending laterally outward from the stem body and overlying and engaging the upper end of the grommet 18. In other embodiments, the upper portion of the stem body 52, above the annular shoulder 62, may include an exterior thread (or other connector or connecting structure) for connecting the stem 16 to an actuator or other device. As an example, the upper portion of the stem body 52 may include a thread (FIGS. 1 and 2) onto which an actuation device may be attached when the valve 14 is used as a tilt valve, as generally known in the art. In yet other embodiments, the valve 14 may be used without any additional actuator and may include a component for profiling or shaping the dispensed product. The stem 16 may be made of the same material as the mounting cup 20, such as polyolefin or other plastic as described above.

In the non-actuated position, the valve 14 is closed with the valve stem 16 generally vertical with the entire disc 60 seated against the flange portion 44B of the grommet 18. When the valve 14 is selectively actuated to move the valve into the actuated or open position, the elongate neck portion 44A is engaged to tilt or rotate the stem 16, thereby disengaging a portion of the disc 60 from the flange portion 44B of the grommet 18 to open the valve 14. (In one or more embodiments, the stem may be pushed down or vertically actuated to open the valve.) When the valve 14 is operated and in the actuated position, the valve forms an outlet (i.e., a fluid flow passage), fluidly coupling the interior of the container body 12 with the outlet 54 of the valve. Pressurized fluid, such as the propellant and/or product propelled by the propellant, flows through the outlet 54 to be dispensed from the container 10. In particular, in the actuated position a portion of the disc 60 is disengaged from the flange portion 44B, allowing the flowable product to enter the stem 16 through one or more of the inlets 56 and travel upward (relative to the orientation shown) through the stem body 52 and out of the valve 14. It is understood the container body 12 and/or the valve 14 may have other constructions than described herein without departing from the scope of the present disclosure. For example, the valve may be a push-down or vertically actuated type valve, whereby an axial force is applied to the stem to unseat the disc from the grommet, or another type of valve.

Once, the flowable product is filled into the container body 12 and the valve 14 is attached to the container body 12, the interior of the container 10 can be pressurized with the propellant. Once the interior of the container 10 is pressurized, the mounting cup 20 deflects (e.g. deforms). In particular, the mounting cup 20 is configured to deflect under pressure to form a leak proof seal between the mounting cup and the container body 12. Once the container 10 is pressurized, the pressure pushes upward against the base 24 of the mounting cup 20, thereby causing the detents 34 to deflect upward and further push against the underside of the lip 13 to maintain the mounting cup attached to the container body 12 when the container body is pressurized. As a result of the pressure pushing against the base 24 and the detents 34 pressing against the underside of the lip 13, the annular inner wall 22 deflects or, more specifically, bows radially outward and engages (or further engages) the interior surface of the neck 15 of the container body 12 to form a leak proof seal between the annular inner wall and the neck. The thickness T2 of the base 24 being greater than the thickness T1 of the annular inner wall 22 facilitates deflection or deformation of the annular inner wall to form the leak proof seal with the container body 12. As a result of the deflection of the mounting cup 20 (e.g., annular the inner wall 22), the detents 34 move in a direction that is radially inward and upward. This movement increases the gripping force of the detents 34, further securing the mounting cup 20 to the container body 12. It is appreciated by one skilled in the art that this radially inward and upward movement of the detents 34 is due, in part, to the fact that the continuous lower end of the annular outer wall 28 forms a continuous retaining ring connecting each of the detents 34 to one another. The continuous lower end of the outer wall 28 also provides the necessary strength to keep the detents 34 engaged to the lip 13 and the mounting cup 20 attached the container body 12 when the container 10 is pressurized such that a separate, non-integrally formed reinforcement ring, as known in the art, is not required.

In various embodiments, the pressurized container 10 is designed to safely fail in the presence of excess pressure. In order to provide a pressurized container that will safely fail in the event of excess pressure, the mounting cup 20 is designed to maintain attachment to the container body 12 even during failure. Instead of dispensing of excess pressure through complete detachment of the mounting cup 20, in one or more embodiments the base 24 of the mounting cup 20 bows upward or domes to a generally convex shape when a threshold predetermined pressure inside the container acts against the mounting cup. This upward bowing of the base 24 causes the inner wall 22 to move in an inward direction away from the interior surface of the neck 15 of the container body 12, thereby reducing the effectiveness of the seal between the inner wall 22 and the neck 15 and allowing pressurized fluid in the container body 12 to "leak" out of the container between the mounting cup 20 and the container body, while the detents 34 remain substantially engaged to lip 13. In this embodiment, the threshold internal pressure at which the pressurized fluid "leaks" is below the pressure at which the container body 12 and the mounting cup 20 connection to the container body respectively fail. In one example, the threshold pressure is above 160 psi, such as above 250 psi. In this example, the seal created between the inner wall 22 and the neck 15 withstands the internal pressure created when the container 10, which includes the pressurized flowable product, is in an environment of 150° F. for 5 hours.

As a result of the illustrated mounting cup 20 deforming to form a leak proof seal with the container body 12, the valve 14, generally, and the mounting cup, specifically, is free of any additional sealing element (e.g., gasket) positioned between the mounting cup 20 and the container body 12 that would create the leak proof seal, as generally known and done in the art. As known in the art, mounting cups include some type of sealing element, such as a lathe cut gasket, laminate gasket, or sleeve gasket, to form a leak proof seal between the mounting cup and the container body (e.g., between the mounting cup and the lip or bead of the container body). Typically, lathe cut gaskets made of rubber are used to provide a leak proof seal between a mounting cup and a container body. The mounting cup 20 described herein requires no such sealing element or gasket to form a leak proof seal with the container body 12. In other embodiments, as mentioned above, a gasket can be used to supplement the mounting cup's natural sealing ability.

Figure 10:
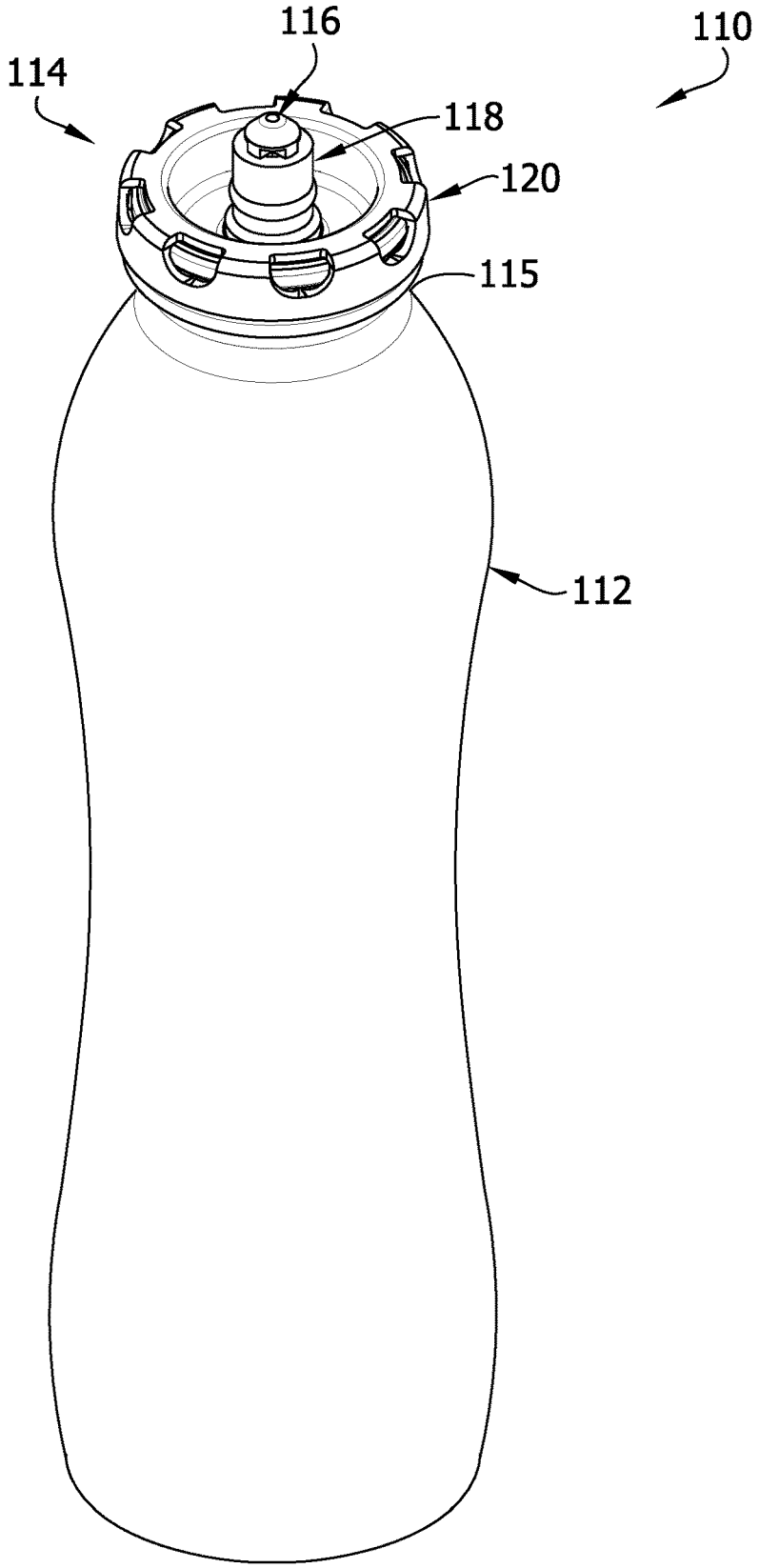
FIG. 10 is another embodiment of a pressurized container.
Figure 11:
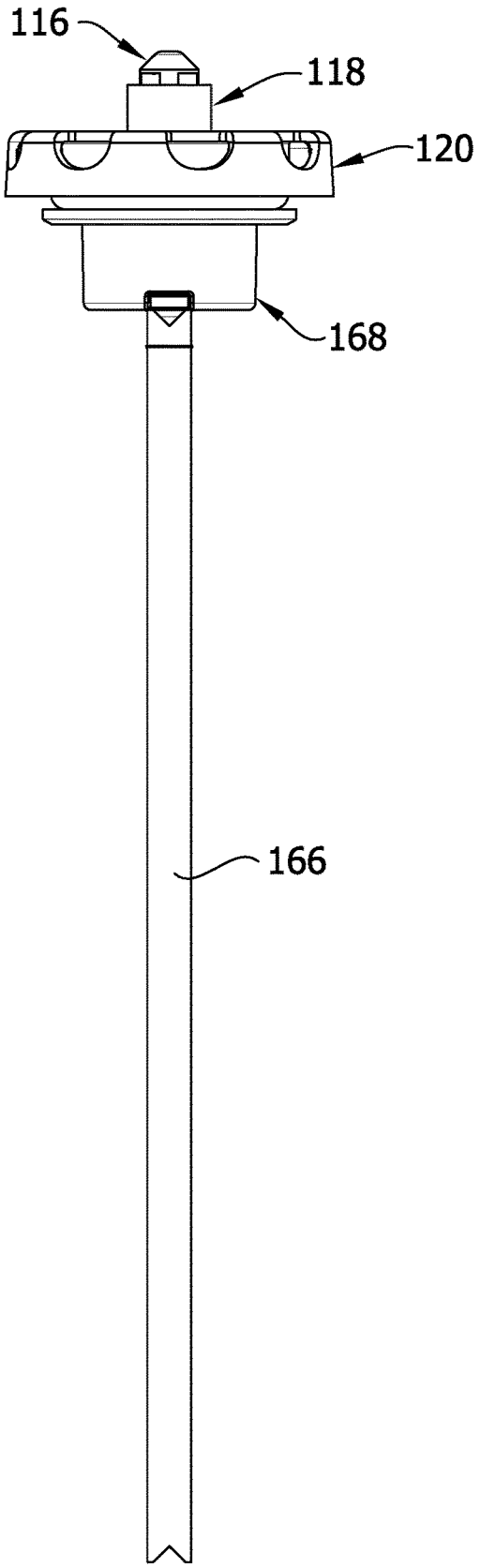
FIG. 11 is a front elevation of FIG. 10, with a container body removed.
Figure 12:
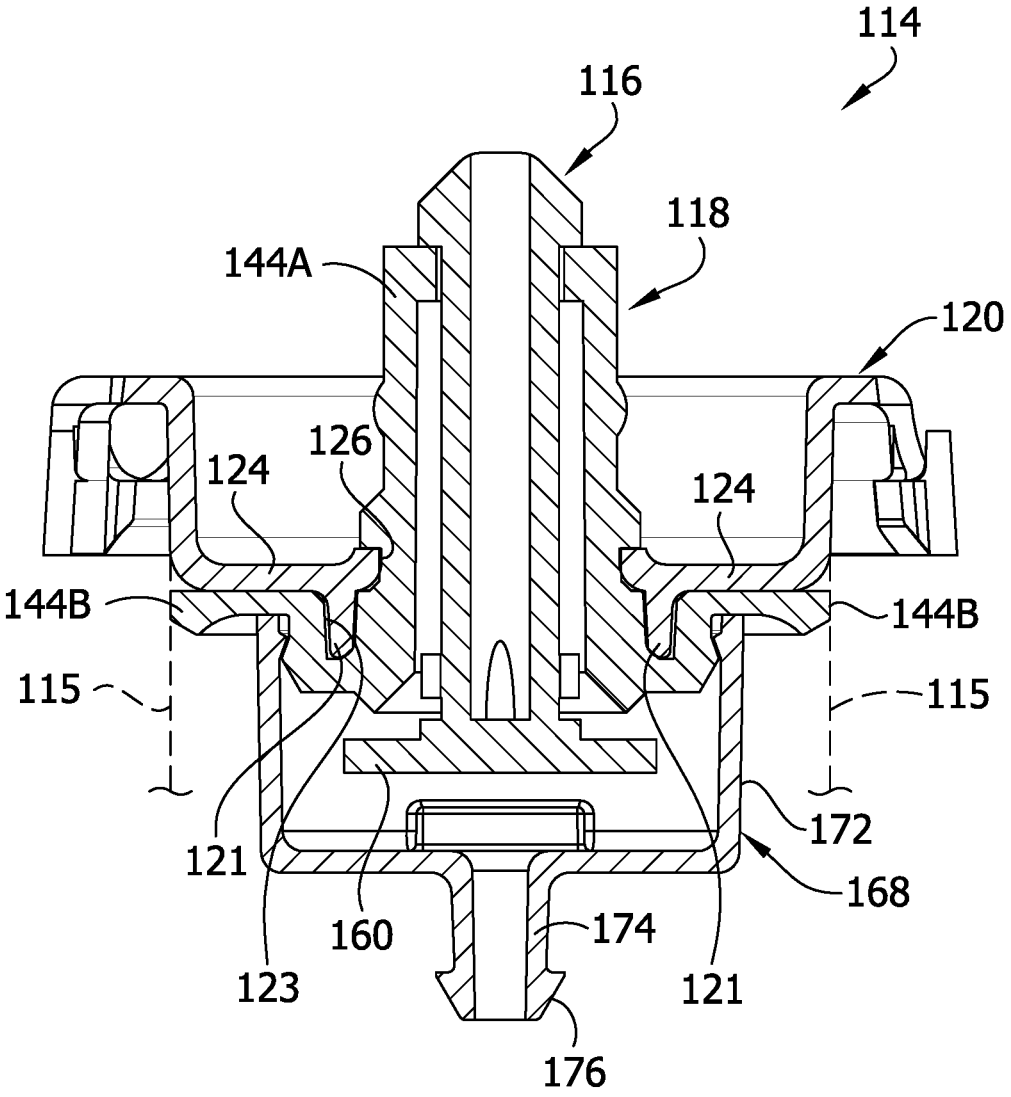
FIG. 12 is an enlarged cross-sectional view of a valve of FIG. 10.
Figure 13:
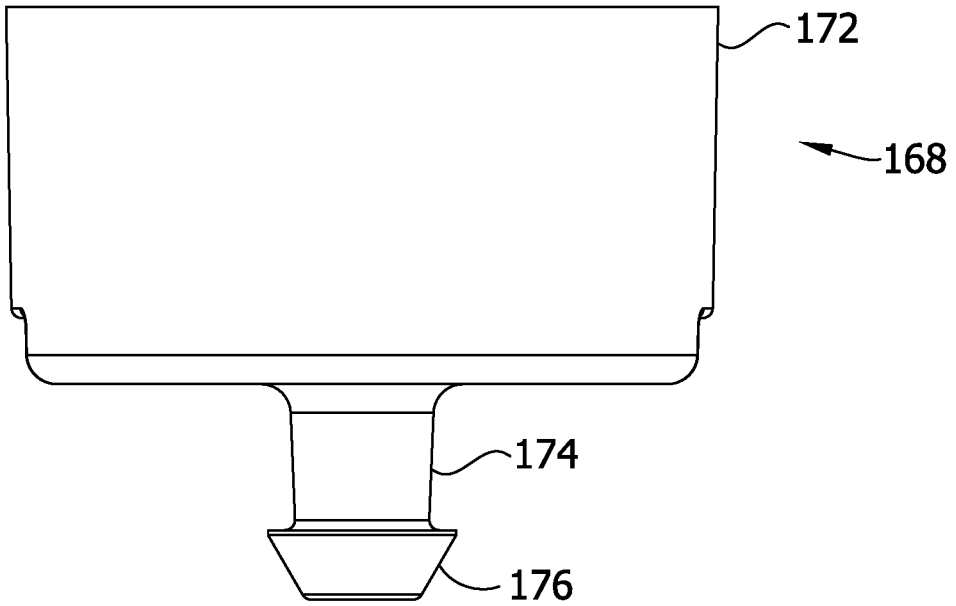
FIG. 13 is a front elevation of a dip tube adapter of FIG. 10.

Referring to FIGS. 10-12, another embodiment of a pressurized container is generally indicated at reference numeral 110. The pressurized container 110 can includes a dip tube 166. The dip tube 166 extends from the dip tube adapter 168 (FIG. 12) and terminates near the bottom of the container body 112 (or collapsible bag in the container body 112 as appropriate). In the illustrated embodiment, the dip tube 166 includes a notched portion at the bottom end to allow continuous uptake of the flowable product and propellant without a seal being formed between the bottom end of the dip tube 166 and the bottom of the container body 112 (or collapsible bag in the container body 112). Dip tube adapter 168 includes an annular wall 172 and a cylindrical surface 174 extending from the bottom portion thereof, terminating in a shoulder 176, the cylindrical surface 174 receiving the dip tube 166. A through-hole extends through the dip tube adapter 168 (including through cylindrical surface 174) and receives the valve stem 116 and grommet 118. It is understood that the dip tube 166 and the dip tube adapter 168 may be incorporated in any of the other embodiments of the present disclosure.

Referring to FIG. 12, the mounting cup 120 is similar to the mounting cup 20, other than an annular rib 121 extending downward from the base 124 and surrounding the opening 126. The annular rib 126 mates with an annular groove 123 defined by the grommet 118 (e.g., defined by the flange 144B) and surrounding the neck portion 144A. It is understood that the mounting cup 120 may be incorporated in any of the other embodiments of the present disclosure.

Referring to FIG. 12, the flange portion 144B of the grommet 118 can extend to or beyond the edge of the base 124 of the mounting cup 120 and contact the interior surface of the neck 115 (or other interior surface) of container body 112, thereby providing a seal between grommet 118 and container body 112. This embodiment of the grommet 118 may be incorporated in any of the other embodiments of the present disclosure.

The illustrated valve 114 is a "normally open valve" that is biased in the open position, as shown in FIG. 12. In particular, the stem 116 is configured to be in a downward, open position when an internal pressure inside the container body 112 applied to the lower face of the disc 160 is below a threshold pressure. That is, the stem 116 floats in the grommet 118 such that gravity biases the stem 116 in the downward, open position. In one example, the stem 116 is configured to be in the downward, open position when internal pressure of the container is at or below about 60 psi, or at or below about 50 psi, or at or below about 40 psi, or at or below about 30 psi, or at or below about 20 psi, or at or below about 10 psi, or at or below about 8 psi. Adjusting one or both of the mass of the stem 116 and the surface area of the lower surface of the disc 160, for example, adjusts the pressure at which the valve 114 opens. In this embodiment, any remaining pressure within a spent container 110 is released, prior to being processed for recycling. This embodiment of the stem 116 and valve 114 may be incorporated in any of the other embodiments of the present disclosure.

Figure 14:
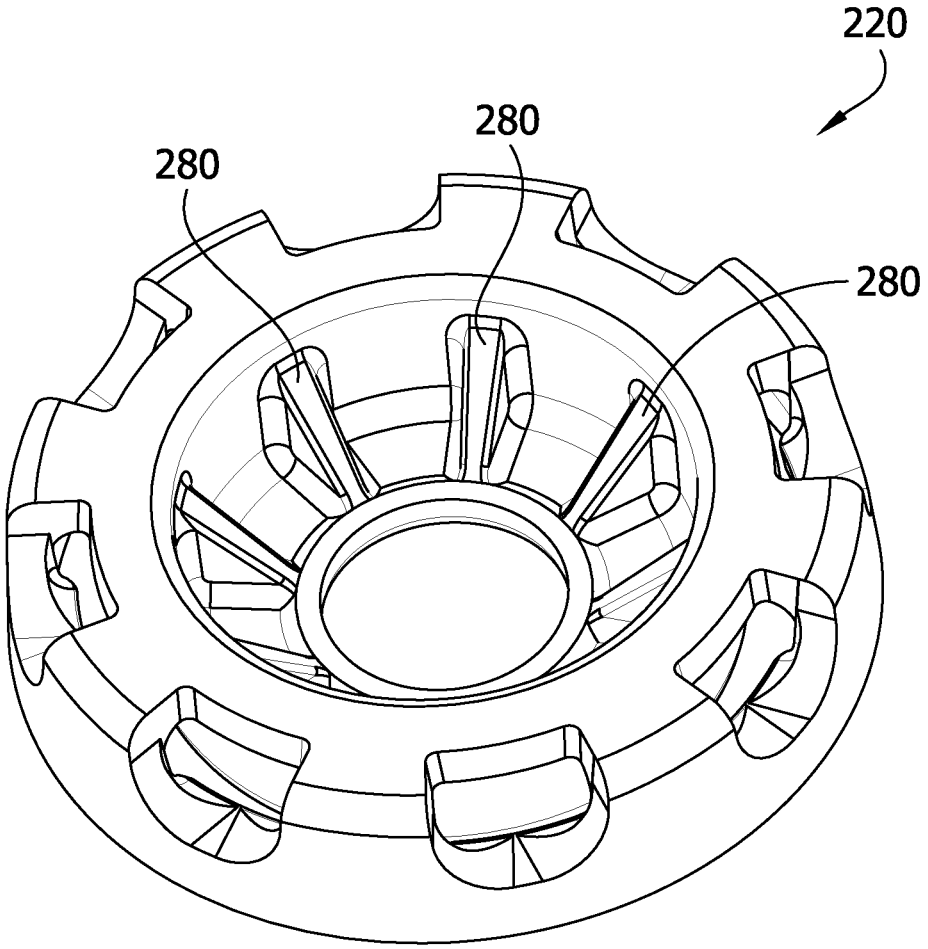
FIG. 14 is an enlarged perspective of another embodiment of a mounting cup.
Figure 15:
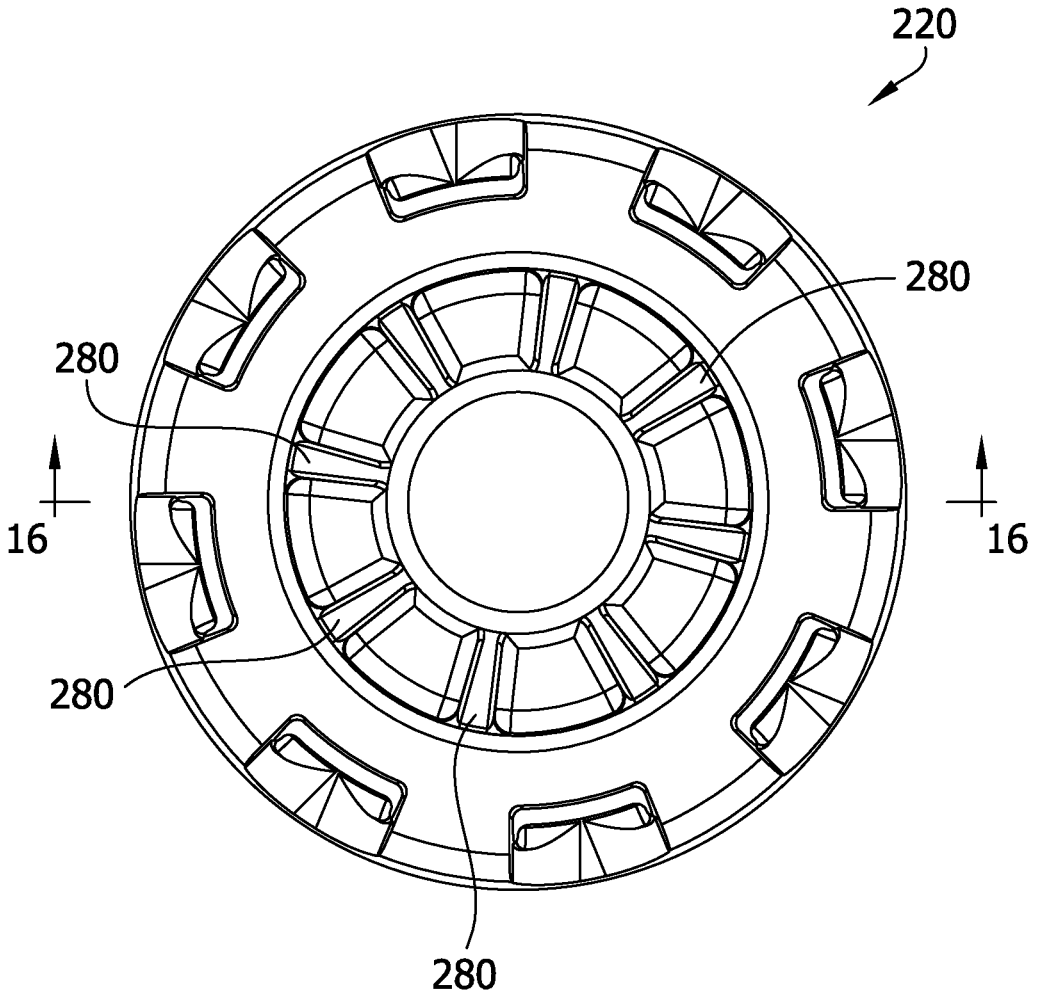
FIG. 15 is a top plan view of the mounting cup of FIG. 14.
Figure 16:
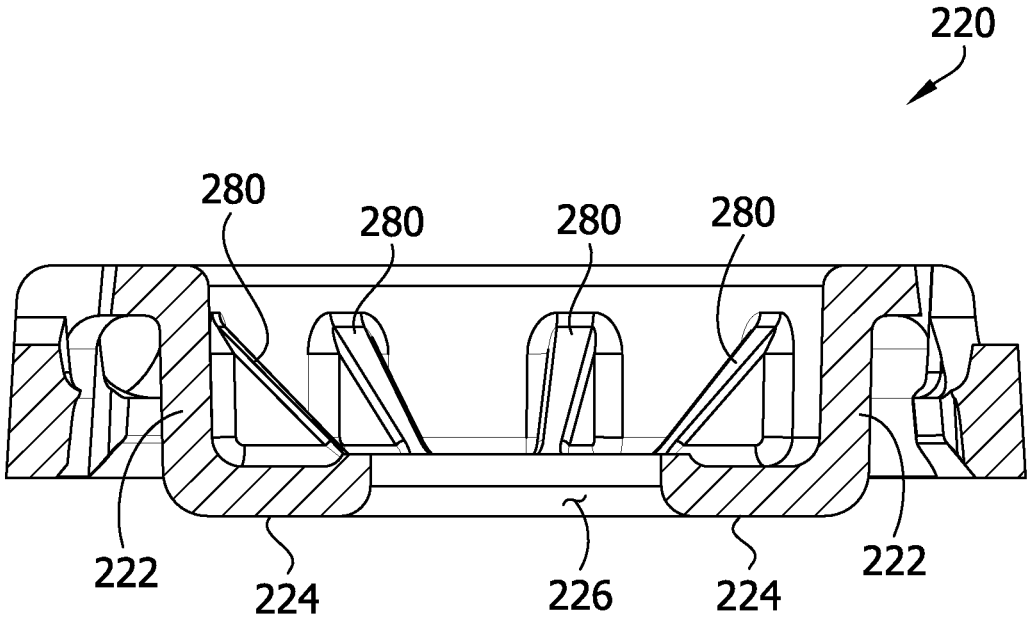
FIG. 16 is a cross-sectional view of the mounting cup taken through the line 16-16 in FIG. 15.

Referring to FIGS. 14-16, another embodiment of a mounting cup is generally indicated at reference numeral 220. This embodiment is similar to the other embodiments described above, with the exception of this mounting cup 220 including a plurality of reinforcing gussets 280. The gussets 280 inhibit upward flexing or bowing of the base 224 and distribute the pressure or force applied to the base to the inner wall 222. The gussets 280 extend between the base 224 and the inner wall 222 within the space defined by the base and the inner wall. The gussets 280 are spaced apart from one another circumferentially around the opening 226. Each gusset 280 extends radially inward from the inner wall 222 to, or generally adjacent to, the edge defining the opening 226. As shown in FIG. 16, in this embodiment the thicknesses of the base 224 and the inner wall 222 may be equal or substantially equal because the gussets 280 reinforce the base. The gussets 280 may be incorporated in any of the other embodiments of the present disclosure.

In one or more embodiments, the container is made entirely from plastic components such that the container body, the mounting cup, the stem, and the grommet are all formed of (e.g., comprise, consist essentially of, or consist of) plastic, as described above, for example, recyclable plastic. In certain situations, it is preferable that the container is comprised entirely of plastic materials. For example, certain flowable products, such as cleaners (e.g. bleach), will undergo a chemical reaction if they contact certain materials, such as metal. This chemical reaction may produce excess gas inside the container and can cause the container to explode. Further, certain flowable products, such as bleach, may cause degradation of certain materials, such as the rubber gaskets typically used to form the leak proof seal between the mounting cup and container body, as known in the art. Thus, in order for a container to store and dispense bleach (or any product that reacts with metal and/or deteriorates the gasket), it may be desirable to form the container of all plastic components. It may also be desirable for the mounting cup to form a leak proof seal with the container body without the use of a rubber gasket.

In one or more embodiments, the container body comprises or consists of or essentially consists of (e.g., is formed from) polyethylene terephthalate (PET); the mounting cup consists of or essentially consists of (e.g., is formed from) polyethylene terephthalate (PET) or another material (e.g., plastic or recyclable plastic) having a density less than water (e.g., less than about 1 g/cm$^3$); the stem comprises or consists of or essentially consists of (e.g., is formed from) polypropylene (PP) or another material (e.g., plastic or recyclable plastic) having a density less than water (e.g., less than about 1 g/cm$^3$); and the seal/grommet comprises or consists of or essentially consists of (e.g., is formed from) a thermoplastic elastomer (TPE) having a density less than water (e.g., less than about 1 g/cm$^3$) or another material (e.g., plastic or recyclable plastic) having a density less than water (e.g., less than about 1 g/cm$^3$). In this embodiment or other embodiments, the valve is a three-piece assembly consisting or essentially consisting of the stem, the seal/grommet and the mounting cup coupled to one another.

In view of the above, it will be seen that several features of the disclosure are achieved and other advantageous results obtained.

Having described the disclosure in detail, it will be apparent that modifications and variations are possible without departing from the scope of the disclosure defined in the appended claims. For example, where specific dimensions are given, it will be understood that they are exemplary only and other dimensions are possible.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the disclosure, it is intended that all matter contained in the above description and shown in the accompanying drawings shall be interpreted as illustrative and not in a limiting sense.

What is claimed is:

1. A container for dispensing a flowable product under pressure, the container comprising:

a container body having an opening and configured to contain the flowable product under pressure therein; and a valve coupled to the container body at the opening, the valve being selectively openable to allow dispensing of the flowable product from the container body under pressure, the valve including a stem including a stem body defining a passage therein, and a disc at a lower portion of the stem body;

a seal coupled to the stem body, the seal including a seat sealingly engaging the disc of the stem when the valve is closed, a neck extending from the seat and surrounding at least a longitudinal portion of the stem body; and a mounting cup configured to mount the valve to the container body, the mounting cup including a base and a sidewall extending from the base, wherein the base defines an opening through which the stem and the seal extend such that the sidewall of the mounting cup surrounds at least respective longitudinal portions of the stem body and the neck of the seal, wherein each of the container body, the stem, the seal, and the mounting cup comprises a recyclable plastic; and wherein the stem is biased to an open position under the force of gravity when an upward pressure applied to the disc of the stem is at or below a predetermined threshold pressure.

2. The container set forth in claim 1, wherein the valve is free from a gasket configured to engage any portion of the container body to form a seal between the valve and the container body.

3. The container set forth in claim 1, wherein each of the container body and the valve is free from metal.

4. The container set forth in claim 1, wherein each of the container body and the valve consists essentially of the recyclable plastic.

5. The container set forth in claim 1, wherein each of the container body, the stem, the seal, and the mounting cup consists essentially of a recyclable plastic.

6. The container set forth in claim 1, wherein the seal is resiliently deformable.

7. The container set forth in claim 1, wherein the recyclable plastic of the seal comprises a thermoplastic elastomer.

8. The container set forth in claim 1, wherein the recyclable plastic of the seal comprises a thermoplastic elastomer, wherein the recyclable plastic of the mounting cup comprises polyethylene terephthalate (PET).

9. A valve for dispensing flowable product from a container body under pressure, the valve comprising:

a stem including a stem body defining a passage therein, and a disc at a lower portion of the stem body;

a seal coupled to the stem body, the seal including a seat sealingly engaging the disc of the stem when the valve is closed, a neck extending from the seat and surrounding at least a longitudinal portion of the stem body; and a mounting cup configured to mount the valve to the container, the mounting cup including a base and a sidewall extending from the base, wherein the base defines an opening through which the stem and the seal extend such that the sidewall of the mounting cup surrounds at least respective longitudinal portions of the stem body and the neck of the seal, wherein each of the stem, the seal, and the mounting cup comprises a recyclable plastic, wherein the stem is biased to an open position under the force of gravity when an upward pressure applied to the disc of the stem is at or below a predetermined threshold pressure.

10. The valve set forth in claim 9, wherein the valve is free from a gasket configured to engage any portion of the container body to form a seal between the valve and the container body.

11. The valve set forth in claim 9, wherein the valve is free from metal.

12. The valve set forth in claim 9, wherein the valve consists essentially of the recyclable plastic.

13. The valve set forth in claim 9, wherein each of the stem, the seal, and the mounting cup consists essentially of a recyclable plastic.

14. The valve set forth in claim 9, wherein the seal is resiliently deformable.

15. The valve set forth in claim 9, wherein the recyclable plastic of the seal comprises a thermoplastic elastomer.

16. The valve set forth in claim 9, wherein the recyclable plastic of the seal comprises a thermoplastic elastomer, wherein the recyclable plastic of the mounting cup comprises polyethylene terephthalate (PET).

17. The valve set forth in claim 9 in combination with the container body, wherein the container body comprises polyethylene terephthalate (PET).

18. The valve set forth in claim 9, wherein the valve is a three-piece assembly consisting of the stem, the seal, and the mounting cup.

19. The valve set forth in claim 9, wherein the mounting cup comprises PET and all other components of the valve consist essentially of recyclable plastic material having a density less than water.

* * * * *